US010029478B2

(12) United States Patent
Inaba

(10) Patent No.: US 10,029,478 B2
(45) Date of Patent: Jul. 24, 2018

(54) PRINTER AND METHOD FOR OPERATING THE SAME

(71) Applicant: TOSHIBA TEC KABUSHIKI KAISHA, Tokyo (JP)

(72) Inventor: Hiroyuki Inaba, Izunokuni Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 9 days.

(21) Appl. No.: 15/258,630

(22) Filed: Sep. 7, 2016

(65) Prior Publication Data

US 2017/0015123 A1 Jan. 19, 2017

Related U.S. Application Data

(62) Division of application No. 14/800,438, filed on Jul. 15, 2015, now Pat. No. 9,463,647.

(51) Int. Cl.

| | |
|---|---|
| ***B41J 3/54*** | (2006.01) |
| ***B41J 25/00*** | (2006.01) |
| ***B41J 3/00*** | (2006.01) |
| ***B41J 2/50*** | (2006.01) |
| ***B41J 2/335*** | (2006.01) |
| ***B41J 2/32*** | (2006.01) |
| ***B41J 29/38*** | (2006.01) |

(52) U.S. Cl.

CPC ..... *B41J 3/546* (2013.01); *B41J 2/32* (2013.01); *B41J 2/335* (2013.01); *B41J 2/50* (2013.01); *B41J 3/00* (2013.01); *B41J 3/54* (2013.01); *B41J 25/001* (2013.01); *B41J 29/38* (2013.01)

(58) Field of Classification Search

CPC ... B41J 3/546; B41J 2/335; B41J 29/38; B41J 2/32; B41J 2/50; B41J 3/00; B41J 3/54; B41J 25/001

See application file for complete search history.

(56) References Cited

U.S. PATENT DOCUMENTS 4,205,770 A * 6/1980 Wojdyla ..... B41J 11/48 101/228

4,280,036 A 7/1981 Fukatsu (Continued)

FOREIGN PATENT DOCUMENTS

JP 215366 1/1990

JP 2010214617 A 9/2010

*Primary Examiner* — Justin Seo

(74) *Attorney, Agent, or Firm* — Patterson & Sheridan, LLP

(57) ABSTRACT

A printer includes a discharge unit, a first printing unit disposed along a sheet conveying path extending from the discharge unit and configured to print an image on a first sheet while the first sheet is conveyed from the discharge unit to the first printing unit and then to the discharge unit, a second printing unit disposed farther from the discharge unit than the first printing unit along the sheet conveyance path and configured to print an image on a second sheet while the second sheet is conveyed towards the discharge unit therethrough, using a printing method that is different from a printing method of the first printing unit, and a control unit configured to determine whether or not each of the first and second printing unit is in use and control only one of the first and second printing units to print the image, based on the determination.

8 Claims, 4 Drawing Sheets

(56) References Cited

U.S. PATENT DOCUMENTS

| | | | |
|---|---|---|---|
| 4,600,828 | A | 7/1986 | Nogami et al. |
| 5,017,026 | A | 5/1991 | Takesako et al. |
| 8,522,229 | B2 | 8/2013 | Ando et al. |
| 8,537,189 | B2 | 9/2013 | Shiraishi |
| 9,242,490 | B1 | 1/2016 | Nozaki |
| 2010/0230889 | A1 | 9/2010 | Eoka et al. |
| 2010/0231681 | A1 | 9/2010 | Nihashi et al. |
| 2011/0057978 | A1 | 3/2011 | Harashina |

* cited by examiner

PRINTER AND METHOD FOR OPERATING THE SAME

CROSS-REFERENCE TO RELATED APPLICATIONS

This application is a division of U.S. patent application Ser. No. 14/800,438, filed on Jul. 15, 2015 (parent case). Also, U.S. patent application Ser. No. 15/192,178, was filed on Jun. 24, 2016, as another division of the parent case. The entire contents of both applications are incorporated herein by reference.

FIELD

Embodiments described herein relate generally to a printer which performs printing with a plurality of printing units and in which a medium transport path is used in common with the plurality of printing units.

BACKGROUND

Currently, a printer is used in financial institutions for printing images on a booklet such as a bankbook and a ledger sheet such as a bank statement. Typically, a dot printer is used to print images on the booklet. The booklet is inserted into the dot printer by a user and printing is performed thereon. On the other hand, a thermal printer is typically used to print the ledger sheet, and a sheet stored in the thermal printer is used to print the ledger sheet. One type of a printer has both a dot printing unit and a thermal printing unit, and has a single sheet conveyance path that is shared by the dot printing unit and the thermal printing unit to make the printer smaller.

However, as the single sheet conveyance path is used, one of the printing units cannot perform printing while the other one of the printing units performs printing. One solution to avoid such a conflict between the two printing units is controlling the timing of printing by an external device. However, with this solution, when there is a modification of the print settings or replacement of the printing units, the timing of printing may need to be adjusted and the external device needs to be reprogrammed accordingly.

DETAILED DESCRIPTION

One or more embodiments provides a printer in which a transport path is used in common with a plurality of printing units and which is controlled without modifying a control program of an external device.

In general, according to one embodiment, a printer includes a discharge unit, a first printing unit disposed along a sheet conveying path extending from the discharge unit and configured to print an image on a first sheet while the first sheet is conveyed from the discharge unit to the first printing unit and then to the discharge unit, a second printing unit disposed farther from the discharge unit than the first printing unit along the sheet conveyance path and configured to print an image on a second sheet while the second sheet is conveyed towards the discharge unit therethrough, using a printing method that is different from a printing method of the first printing unit, and a control unit configured to determine whether or not each of the first and second printing unit is in use and control only one of the first and second printing units to print the image, based on the determination.

Hereinafter, the printer according to an exemplary embodiment will be described in detail with reference to the drawings.

Figure 1:
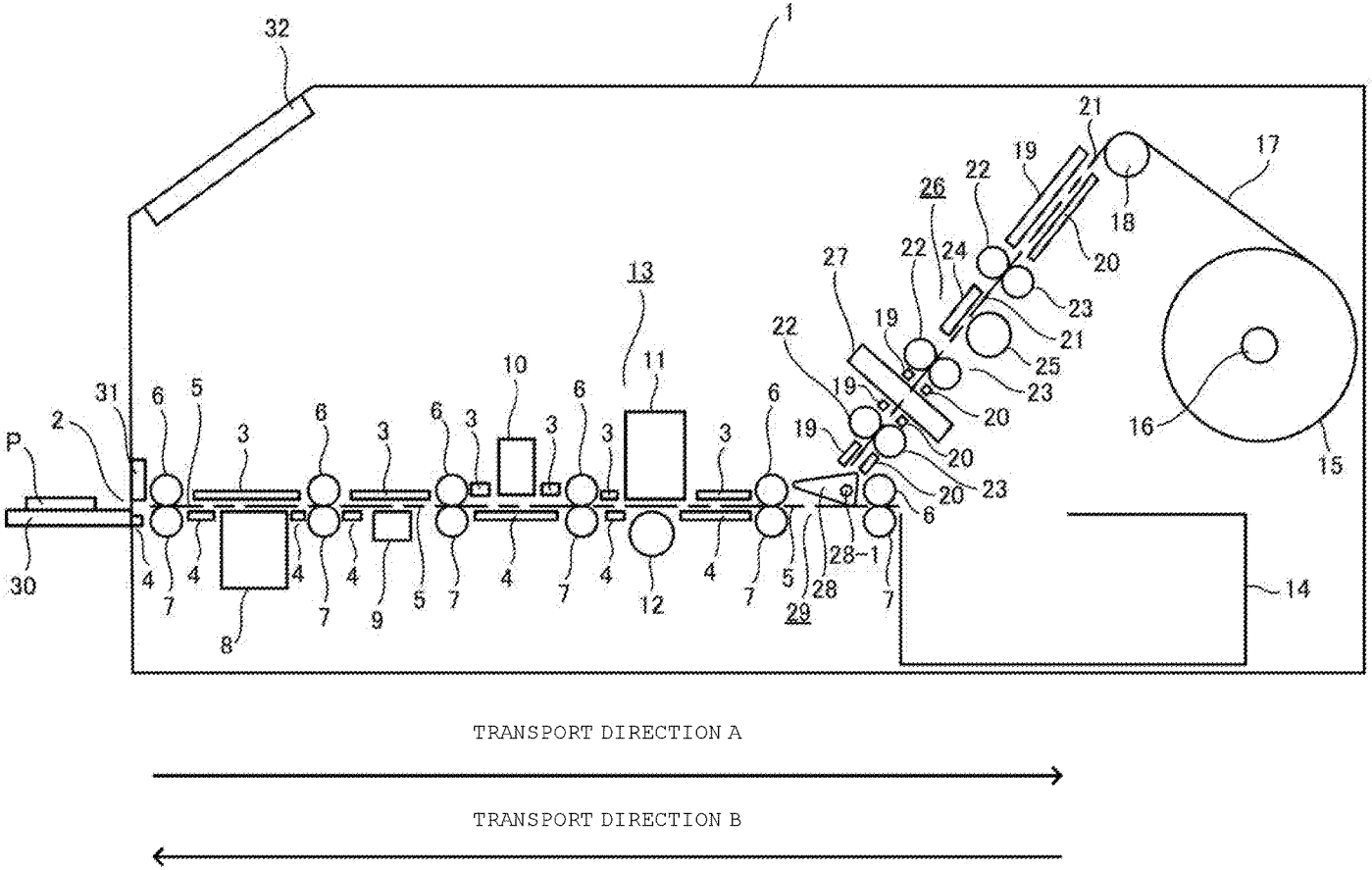
FIG. 1 illustrates main components of a printer according to an embodiment.

FIG. 1 illustrates main components of a printer according to a first embodiment.

A multifunction printer 1 includes a plurality of printing mechanisms different from one another. According to the embodiment, in FIG. 1, the left side is referred to as a front side of the multifunction printer 1 and the right side is referred to as a rear side of the multifunction printer 1.

An insertion and discharge slit 2 is provided on the front side of the multifunction printer 1. Through the insertion and discharge slit 2, a booklet P such as a bankbook is inserted, or the booklet P on which printing is completed or roll paper 15 (described below), which is cut off as a ledger sheet after printing is completed is discharged to the outside of the multifunction printer 1. According to the embodiment, paper in a roll shape is described as the roll paper 15 and a sheet which is cut off after the necessary printing on the roll paper 15 is performed is described as a ledger sheet C.

A collection storage 14 is provided on the rear side of the multifunction printer 1 and collects and stores the booklet P or the ledger sheet C which a user forgets to take out.

A first upper transport guide 3 and a first lower transport guide 4 extend from the insertion and discharge slit 2 to the collection storage 14. A first paper transport path 5 is formed between the first upper transport guide 3 and the first lower transport guide 4, and the booklet P and the roll paper 15 are transported through the first paper transport path 5. According to the embodiment, a transport direction of the booklet P or the ledger sheet C from the insertion and discharge slit 2 to the collection storage 14 is described as a transport direction A. When there is not provided a specific description, in FIG. 1, the left side, which is the front side, is illustrated as an upstream side and the right side is illustrated as a downstream side.

A feed roller 6 and an idler roller 7 are disposed to face each other on the downstream side of the insertion and discharge slit 2 in the transport direction A. The feed roller 6 is rotatable by a motor (not illustrated) and the idler roller 7 is disposed opposite to the feed roller 6 across the first paper transport path 5. The feed roller 6 and the idler roller 7 are a pair, and the booklet P or the ledger sheet C is nipped therebetween and is transported therethrough. A plurality of pairs of the feed rollers 6 and the idler rollers 7 is provided along the first paper transport path 5.

In addition, an alignment unit 8 is provided on the downstream side of the insertion and discharge slit 2 in the transport direction A. The alignment unit 8 includes a paper sheet position detecting sensor, a shutter, a paper sheet nip mechanism, an alignment side end wall (not illustrated) and corrects an orientation, a position, or the like, of the booklet P inserted from the insertion and discharge slit 2 so that the booklet P moves to a predetermined position and a predetermined orientation.

A magnetic stripe (MS) reading and writing unit 9 is provided on the downstream side of the alignment unit 8 in the transport direction A. The MS reading and writing unit 9 performs reading and writing of information in a magnetic stripe portion (not illustrated) which is provided on the rear surface of the booklet P.

A page line finder (PLF) 10 is provided on the downstream side of the MS reading and writing unit 9 in the transport direction A. The PLF 10 detects a page of the booklet P opened at the moment and the last printed line on the page.

A dot head 11 and a platen roller 12 are disposed to face each other on the downstream side of the PLF 10 in the transport direction A. The platen roller 12 is disposed opposite to the dot head 11 across the first paper transport path 5. A first print unit 13 includes the dot head 11 and the platen roller 12 and performs printing on the booklet P.

The collection storage 14 is provided on the downstream side of the first print unit 13 in the transport direction A.

The roll paper 15, which is paper wound around a winding shaft 16 supported rotatably with respect to a frame (not illustrated), is loaded on the rear side of the multifunction printer 1.

A heat-sensitive layer on which color appears by heating is formed only on a printing surface A17 of the roll paper 15.

In addition, in the multifunction printer 1, an idler roller 18 that applies constant tension to the roll paper 15 is provided.

A second upper transport guide 19 and a second lower transport guide 20 extend from the idler roller 18 toward the front side of the multifunction printer 1. A second paper transport path 21 is formed between the second upper transport guide 19 and the second lower transport guide 20, and the roll paper 15 is transported through the second paper transport path 21. The second paper transport path 21 is joined with the first paper transport path 5 on the downstream side of the first print unit 13 in the transport direction A. According to the embodiment, a transport direction of the roll paper 15 or the ledger sheet C from the idler roller 18 toward the insertion and discharge slit 2 through a joining section 29, which is a joining position of the first paper transport path 5 with the second paper transport path 21, is described as a transport direction B.

A feed roller 22 and an idler roller 23 are disposed to face each other on the downstream side of the idler roller 18 in the transport direction B. The feed roller 22 is rotatable by a motor (not illustrated) and the idler roller 23 is disposed opposite to the feed roller 22 across the second paper transport path 21. The feed roller 22 and the idler roller 23 are a pair, and the roll paper 15 is nipped therebetween and is transported therethrough. A plurality of pairs of the feed rollers 22 and the idler rollers 23 is provided along the second paper transport path 21.

A thermal print head 24 and a platen roller 25 are provided on the downstream side of the idler roller 18 in the transport direction B. The platen roller 25 is disposed opposite to the thermal print head 24 across the second paper transport path 21 and is rotatable by a motor (not illustrated). A second print unit 26 includes the thermal print head 24 and the platen roller 25 and performs printing on the printing surface A17 of the roll paper 15 at the second print unit 26.

A cutter 27 is disposed on the downstream side of the second print unit 26 in the transport direction B. The cutter 27 includes a stationary blade and a movable blade (both not illustrated) and cuts the roll paper 15 inserted into a slit (not illustrated) which is provided in the cutter 27 by causing the movable blade to slide to the stationary blade by driving a cutter motor (not illustrated). Here, the cutter 27 is a so-called sliding-type cutter in which the movable blade slides to the stationary blade, but may not be limited thereto. The cutter 27 may be a so-called rotary-type cutter that cuts paper by causing the movable blade to rotate and to come in contact with the stationary blade.

The first paper transport path 5 and the second paper transport path 21 are joined with each other on the downstream side of the cutter 27 in the transport direction B. A flapper 28 is provided in the joining section 29, which is the joining position. The flapper 28 is rotatable about a flapper rotating shaft 28-1. When the flapper 28 is rotated counterclockwise, the second paper transport path 21 and the first paper transport path 5 communicate with each other. When the flapper 28 is rotated clockwise, the transport may be performed only through the first paper transport path 5 from the insertion and discharge slit 2 to the collection storage 14.

In addition, an insertion and discharge table 30 is provided in the vicinity of the insertion and discharge slit 2 on the front side of the multifunction printer 1. The insertion and discharge table 30 is used to temporarily support the booklet P or the ledger sheet C when the booklet P is inserted into the multifunction printer 1 and when the booklet P or the ledger sheet C is discharged therefrom. In addition, a collection sensor 31 that detects whether a user takes away the booklet P or the ledger sheet C discharged from the insertion and discharge slit 2. In addition, a display unit 32 that displays various states of the multifunction printer 1 including an error message indicating that a paper jam occurred or a piece cut of paper is included is provided on an upper surface of the multifunction printer 1.

Figure 2:
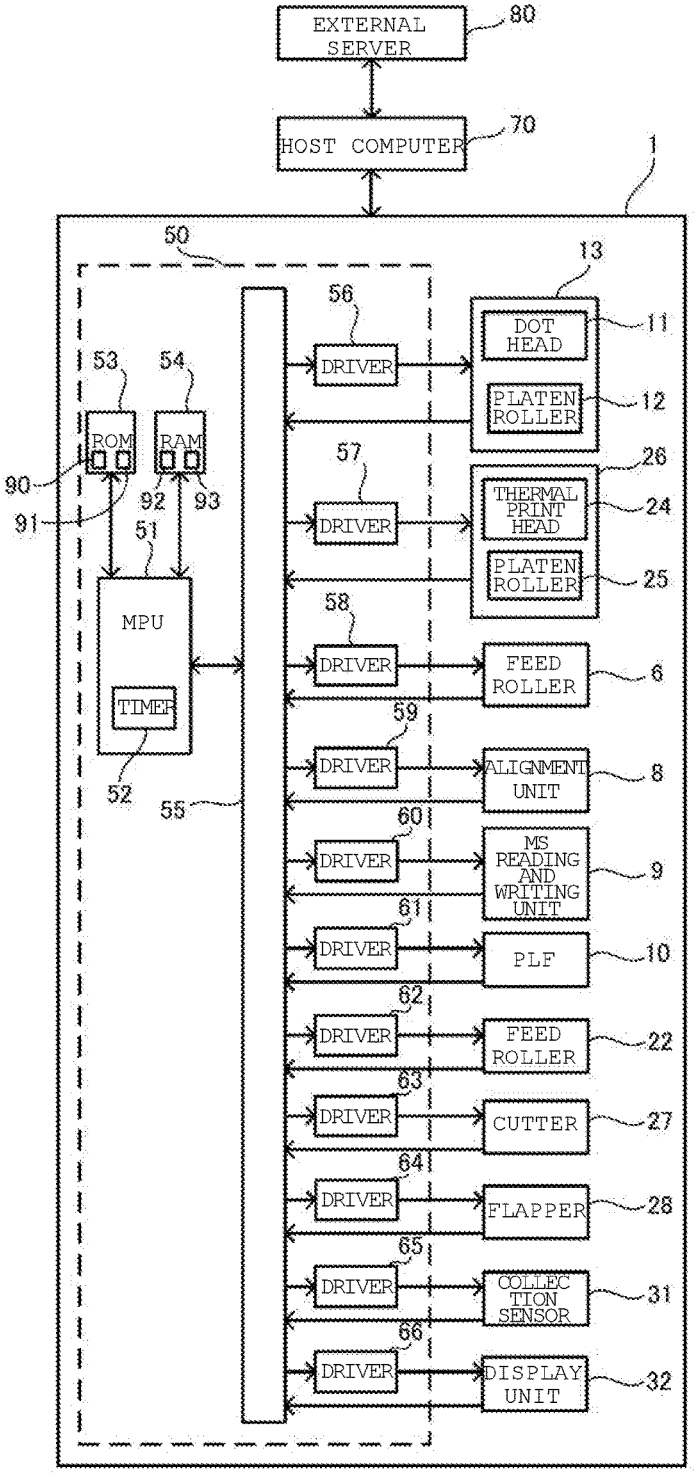
FIG. 2 is a block diagram of the printer according to the embodiment.

FIG. 2 is a block diagram of a control circuit of the multifunction printer 1 according to the embodiment. A controller 50 performs control of transport of a paper sheet, printing, cutting of a paper sheet, discharge of a paper sheet, collection of a paper sheet, detection of collection amount, and a display of a state of the multifunction printer 1.

The controller 50 performs communication with a host computer 70 and various control operations and includes a microcomputer. In addition, the host computer 70 is connected to an external server 80, such as the one located in a financial institution, which manages savings information or the like.

A microprocessor unit (MPU) 51 of the controller 50 performs various control or arithmetic operations such as paper sheet transport control, printing control, paper sheet cutting control, paper sheet discharge control, and paper sheet collecting control in accordance with a program.

In addition, the MPU 51 includes a timer 52 as a unit that performs setting and control of time.

A ROM 53 and a RAM 54 are disposed, in the controller 50, as main memory units that store a control program that is executed by the MPU 51, data that is obtained during the control or arithmetic operation, or the like.

The ROM 53 is a read only memory that includes the control program, a table, or the like, and the RAM 54 is a random access memory that stores data that is obtained during the arithmetic operation, or the like.

In addition, a first print unit program 90 and a second print unit program 91 are stored in the ROM 53. In addition, a first print unit exclusive portion 92 and a second print unit exclusive portion 93 are included in the RAM 54.

An input/output unit (I/O) 55 is provided in the controller 50 and the I/O 55 performs gathering of various input data items from the host computer 70 and extraction of control output of the controller 50 to the host computer 70. The I/O 55 is connected to the MPU 51, the ROM 53, and the RAM 54 through a bus.

As units that extract the control output, first, second, third, fourth, fifth, sixth, seventh, eighth, ninth, tenth, and eleventh drivers 56, 57, 58, 59, 60, 61, 62, 63, 64, 65, and 66 are connected to the I/O 55.

The first driver 56 supplies a driving output to the first print unit 13. The second driver 57 supplies a driving output to the second print unit 26. The third driver 58 supplies a driving output to the feed roller 6. The fourth driver 59 supplies a driving output to the alignment unit 8. The fifth driver 60 supplies a driving output to the MS reading and writing unit 9. The sixth driver 61 supplies a driving output to the PLF 10. The seventh driver 62 supplies a driving output to the feed roller 22. The eighth driver 63 supplies a drive signal to the cutter 27. The ninth driver 64 supplies a drive signal to the flapper 28. The tenth driver 65 supplies a driving output to the collection sensor 31. The eleventh driver 66 supplies a drive signal to the display unit 32.

Figure 3:
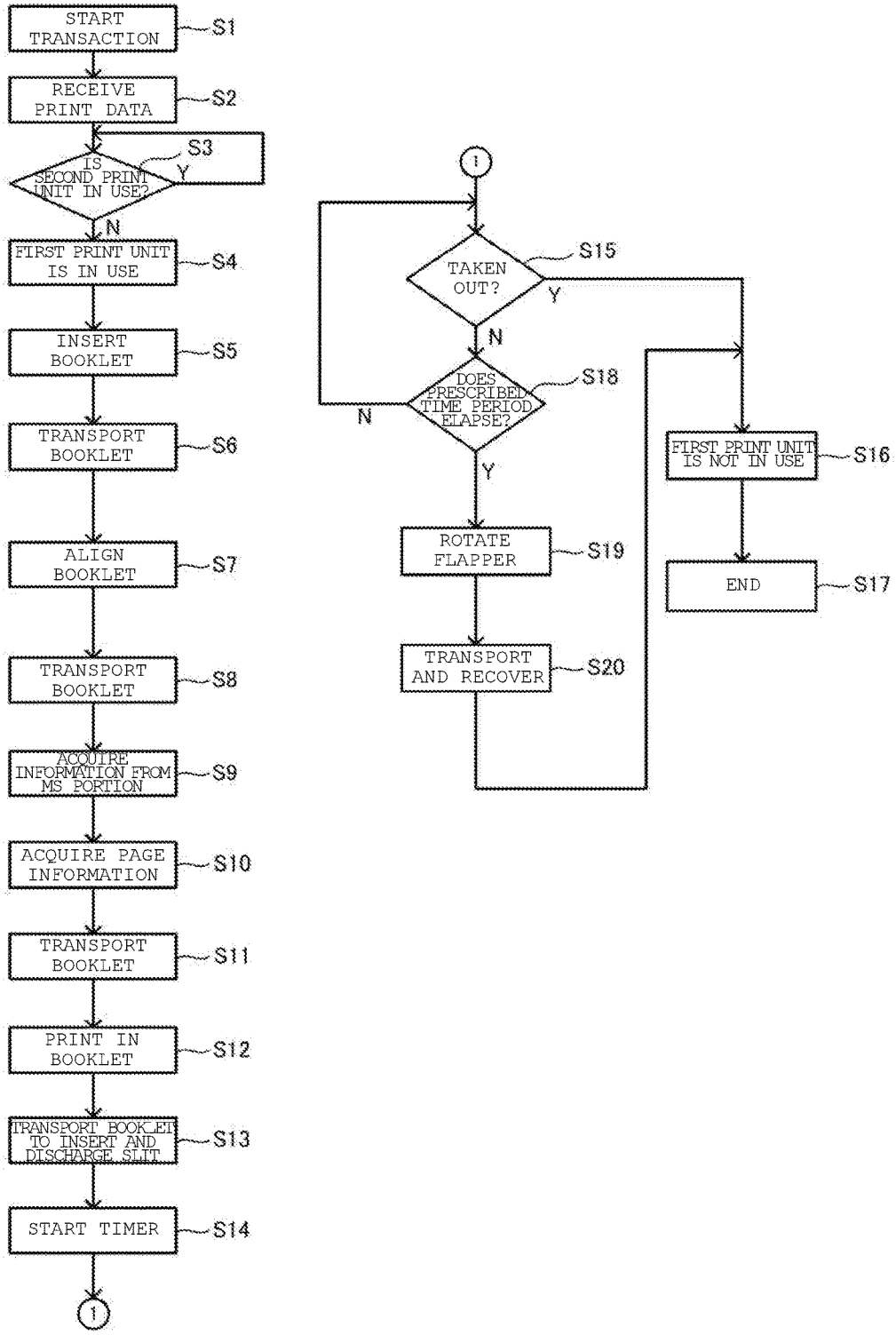
FIG. 3 is a flowchart of operations to control a first print unit of the printer according to the embodiment.
Figure 4:
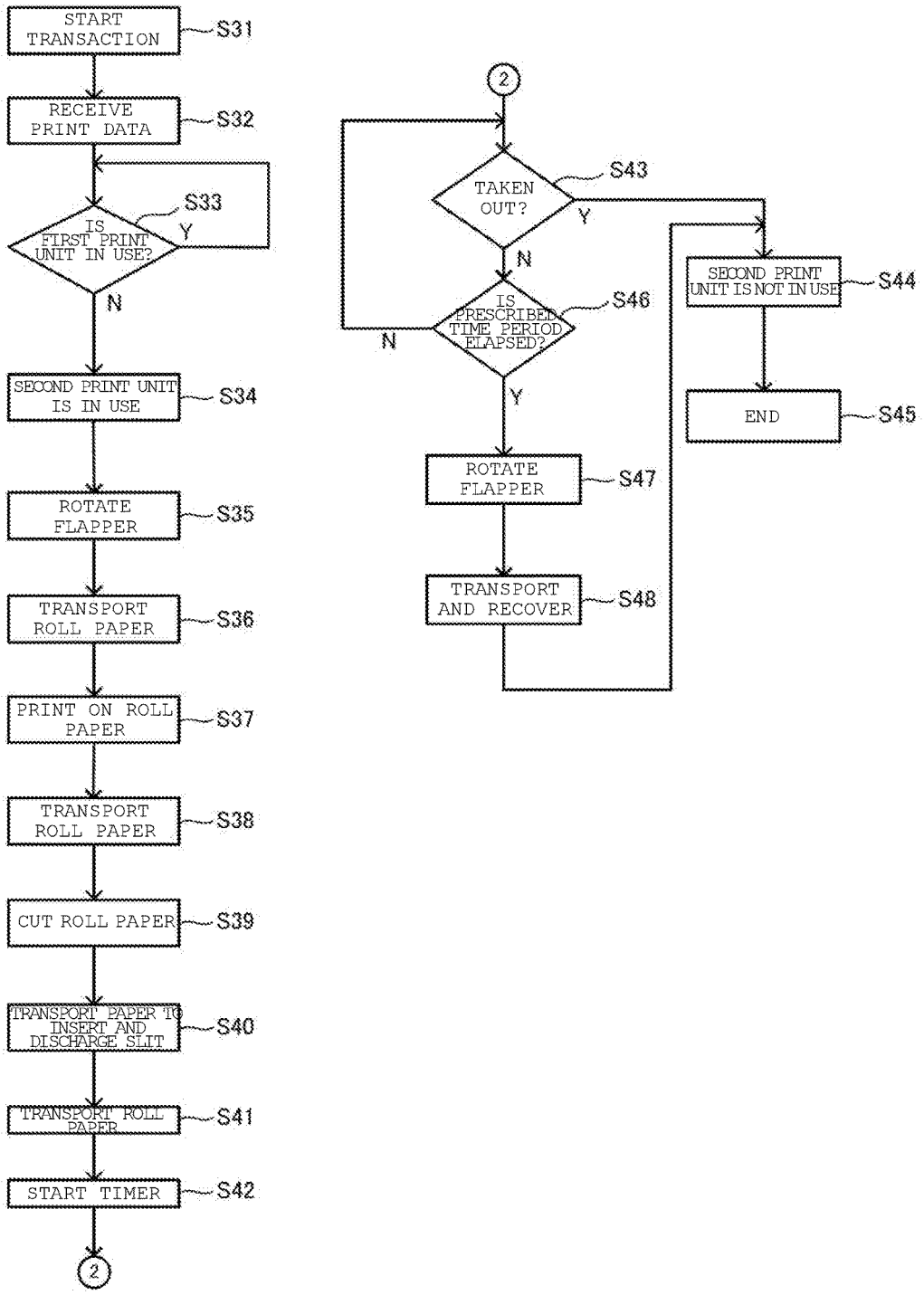
FIG. 4 is a flowchart of operations to control a second print unit of the printer according to the embodiment.

Hereinafter, operation of the multifunction printer 1 is described with reference to FIGS. 3 and 4. The first print unit 13 is described as a dot printing mechanism that performs bookkeeping on a bankbook and the second print unit 26 is described as a thermal printing mechanism.

The multifunction printer 1 is incorporated into an automatic teller machine (ATM) or the like. Here, bookkeeping is described as an example.

The first print unit exclusive portion 92 and the second print unit exclusive portion 93 are provided in the RAM 54. In each of the first print unit exclusive portion 92 and the second print unit exclusive portion 93, 0 or 1 is stored. For example, "1" stored in the first print unit exclusive portion 92 indicates that the first print unit 13 is in use at the moment in the multifunction printer 1. In addition, there may be a state in which "0" indicating a non-use state is stored simultaneously in both of the first print unit exclusive portion 92 and the second print unit exclusive portion 93, but there is no state in which "1" indicating the in-use state is stored in both simultaneously.

When the bookkeeping as a transaction is started (S1), the multifunction printer 1 receives print data for the bookkeeping from an external device (superior application) (S2). The bookkeeping is performed by the first print unit 13. Thus, when the first print unit 13 is used while the second print unit 26 is used, a medium on which the first print unit 13 performs printing and a medium on which the second print unit 26 performs printing may collide with each other on the transport path. Therefore, by referring to the second print unit exclusive portion 93, whether or not the second print unit 26 is checked (S3). When the second print unit 26 is used (Y in S3), the process does not proceed until the operation of the second print unit 26 ends.

Whether the second print unit 26 is used is determined by referring to the data stored in the second print unit exclusive portion 93 (S3). When the second print unit 26 is not used (N in S3), "1" indicating the in-use state is stored in the first print unit exclusive portion 92 and the first print unit 13 is used (S4).

Then, a user opens and inserts the booklet P from the insertion and discharge slit 2 in accordance with an instruction displayed on the display unit 32 or the like (S5). The multifunction printer 1 causes the feed roller 6 to rotate and to transport the booklet P to the alignment unit 8 in cooperation with the idler roller 7 (S6). The alignment unit 8 corrects an orientation, a position, or the like, of the transported booklet P and the booklet P is aligned to a preset position and a preset orientation (S7). Since an alignment mechanism is a known mechanism, a detailed description thereof is omitted.

Then, the aligned booklet P is transported to the first print unit 13 in cooperation of the feed roller 6 with the idler roller 7 (S8). In a course of the transport to the first print unit 13, the MS reading and writing unit 9 is provided on the transport path of the first paper transport path 5. The MS portion (not illustrated) is provided on the rear surface of the booklet P. User information or the like is written as magnetic information in the MS portion of the booklet P. The controller 50 acquires the user information or the like from the MS portion using the MS reading and writing unit 9 during the transport of the booklet P and obtains user transaction information or the like from the external server 80 of financial institutions or the like (S9). Since an interchange of information between the external servers 80 of the financial institutions or the like is a known event, a detailed description thereof is omitted.

The PLF 10 is provided on the downstream side of the MS reading and writing unit 9 on the first paper transport path 5 in the transport direction A. The controller 50 acquires page information provided on the booklet P using the PLF 10 during the transport of the booklet P (S10). As described above, the user transaction information has been already acquired by the controller 50. Information that contains in which page of the booklet P the bookkeeping is performed is included in the transaction information. The information is compared to a detected page acquired by the PLF 10. When another page that is not a proper page to perform the printing this time is opened and inserted, the controller 50 transports the booklet P in the transport direction B and provides an instruction that the user needs to reinsert the booklet with the right page of the booklet opened. When a booklet page turning mechanism unit (not illustrated) is provided in the multifunction printer 1, the booklet P is transported to the booklet page turning mechanism unit and turned over to the right page, and then the booklet may be transported again to the position.

After the booklet P is transported to the first print unit 13 through the MS reading and writing unit 9 and the PLF 10 (S11), the printing is performed in the booklet P between the dot head 11 and the platen roller 12 (S12).

After the printing in the booklet P is completed, the controller 50 rotates the feed roller 6 such that the booklet P is transported in the transport direction B and the transport of the booklet P in cooperation with the idler roller 7 is stopped at a position where the booklet P is placed on the insertion and discharge table 30 and a part of the booklet P protrudes from a front surface 33 to the outside of the multifunction printer 1 (S13).

The collection sensor 31, which is a transmission-type sensor, is provided in the insertion and discharge slit 2. When the booklet P is stopped at the position where the booklet P protrudes from the front surface 33 to the outside of the multifunction printer 1, the collection sensor 31 is capable of detecting whether the booklet P is present at the position.

When the transport of the booklet P is stopped at the position where the part of the booklet P protrudes from the front surface 33 to the outside of the multifunction printer 1, the collection sensor 31 detects that the booklet P is present at the position. When the detection is performed, the timer 52 is started to perform time measurement (S14) and a sensing signal of the collection sensor 31 represents ON. A set time that is measured by the timer 52 will be described below.

Then, the controller 50 determines whether or not the user takes out the booklet P every fixed time (S15). A detection signal of the collection sensor 31 is used to determine whether the user takes out the booklet P. The signal of the collection sensor 31 is ON during the presence of the booklet P. However, when the user takes out the booklet P, the detection signal of the collection sensor 31 is OFF. The switching makes it possible to determine whether the user takes out the booklet P.

When the controller 50 determines that the user takes out the booklet P (Y in S15), "0" indicating the non-use state is stored to the first print unit exclusive portion 92, the exclusiveness of the multifunction printer 1 by the first print unit 13 is cancelled (S16), and the bookkeeping ends (S17).

The controller 50 determines whether or not the user takes out the booklet P every fixed time (S15). When it is determined that the user does not take out the booklet P (N in S15), the controller 50 checks the period of time that has passed since the transport of the booklet P is stopped at the position where the part of the booklet P protrudes from the front surface 33 to the outside of the multifunction printer 1, and determines whether or not the elapsed time exceeds a prescribed time period (S18). Here, the prescribed time period is a period of time after which it may be determined that the user forgets to take out the booklet P and the period of time is from a state in which the transport of the booklet P is stopped at the position where the part of the booklet P protrudes from the front surface 33 to the outside of the multifunction printer 1, that is, a state in which it is possible for the user to take out the booklet P, to a certain time point after certain time elapses. The prescribed time period is, for example, 30 seconds which is set in advance.

When the prescribed time period does not elapse (N in S18), there is a possibility that the user takes out the booklet P. Thus, whether the booklet P is taken out is determined again (S15).

Whether the prescribed time period elapses is determined (S18). When the prescribed time period elapses (Y in S18), it is determined that there is a high possibility that the user forgets to take out the booklet P and the controller 50 first rotates the flapper 28 about the flapper rotating shaft 28-1 in the clockwise direction (S19). Accordingly, the first paper transport path 5 and the collection storage 14 are in a state of communicating with each other. Then, the controller 50 rotates the feed roller 6 such that the booklet P is transported in the transport direction A and the booklet P to be recovered in the collection storage 14 in cooperation with the idler roller 7 (S20). Then, "0" indicating the non-use state is stored in the first print unit exclusive portion 92, the exclusiveness of the multifunction printer 1 by the first print unit 13 is cancelled (S16), and the bookkeeping ends (S17).

Then, the printing performed by the second print unit 26 is described with reference to FIG. 4. Here, performing of output of the ledger sheet C, which is an account statement, is described.

When the output transaction of the ledger sheet C, which is the account statement, is started (S31), the multifunction printer 1 receives print data for the output of the ledger sheet C from the external device (superior application) (S32). Whether or not the first print unit 13 is used is determined based on the data stored in the first print unit exclusive portion 92 (S33). Since the output of the ledger sheet C is performed in the second print unit 26, if the medium on which printing is performed in the second print unit 26 and the medium on which printing is performed in the first print unit 13, these two media may collide with each other on the transport path when the first print unit 13 is used at the moment. When the first print unit 13 is used (Y in S33), the process does not proceed until the operation of the first print unit 13 ends.

Whether the first print unit 13 is used is determined based on the data stored in the first print unit exclusive portion 92 (S33). When the first print unit 13 is not used (N in S33), "1" indicating the in-use state is stored in the second print unit exclusive portion 93 and the second print unit 26 is used (S34).

Then, the controller 50 first rotates the flapper 28 about the flapper rotating shaft 28-1 in the counterclockwise direction (S35). Accordingly, the second paper transport path 21 and the first paper transport path 5 are communicated with each other. Then, the controller 50 rotates the feed roller 22, and the roll paper 15 is caused to be transported to the second print unit 26 in the transport direction B in cooperation with the idler roller 23 (S36). Then, the printing is performed on the roll paper 15 between the thermal print head 24 and the platen roller 25 (S37).

After the printing on the roll paper 15 is completed, the controller 50 rotates the feed roller 22, and the roll paper 15 is caused to be transported in cooperation with the idler roller 23 to a position where a cut position of the roll paper 15 matches a cut position (not illustrated) of the cutter 27 (S38), and then the cutter 27 is driven to cut the roll paper 15 (S39). The cut roll paper 15 is carried across as the ledger sheet C.

Then, in the multifunction printer 1, the feed roller 22 is caused to rotate and the ledger sheet C is conveyed on the insertion and discharge table 30 in cooperation with the idler roller 23. After the ledger sheet C is transported in the transport direction B to a position where a part thereof protrudes from the front surface 33 to the outside of the multifunction printer 1, the transport of the roll paper 15 is stopped (S40). Then, the multifunction printer 1 transports the ledger sheet C to the insertion and discharge slit 2 in the transport direction B and causes the feed roller 22 to rotate and then transports, in cooperation with the idler roller 23, a portion of the roll paper 15 from which the ledger sheet C is cut off to a position on the upstream side of the second print unit 26 in the transport direction B (S41). This process is carried out because time for issuing the next ledger sheet is shortened by transporting the leading end of the roll paper 15 that is prepared for issuing the next ledger sheet C to the position on the upstream side of the second print unit 26 in the transport direction B.

The collection sensor 31, which is a transmission-type sensor, is provided in the insertion and discharge slit 2. When the transport of the ledger sheet C is stopped at the position where the part of the ledger sheet C protrudes from the front surface 33 to the outside of the multifunction printer 1, the collection sensor 31 detects that the ledger sheet C is present at the position and the timer 52 is started to perform time measurement (S42).

Then, the controller 50 determines whether the user takes out the ledger sheet C every fixed time (S43). When the controller 50 determines that the user takes out the ledger sheet C (Y in S43), "0" indicating the non-use state is stored to the second print unit exclusive portion 93, and the exclusiveness of the multifunction printer 1 by the second print unit 26 is cancelled (S44). Then, output of the ledger sheet ends (S45).

When it is determined that the user does not take out the ledger sheet C (N in S43), the controller 50 checks the period of time counted as the time measurement and determines whether the period of time exceeds a prescribed time period (S46).

When the prescribed time period does not elapse (N in S46), whether the ledger sheet C is taken out (S43) is determined again. When the prescribed time period elapses (Y in S46), the controller 50 first rotates the flapper 28 (S47). Then, the controller 50 causes the ledger sheet C to be recovered in the collection storage 14 (S48), the exclusiveness of the multifunction printer 1 by the second print unit 26 is cancelled (S44), and the output of the ledger sheet C ends (S45).

According to the embodiment, similar to that illustrated in FIG. 1, the thermal print head 24 is provided on the upper side and the platen roller 25 is provided across the thermal print head 24 through the second paper transport path 21. However, since the printed surface of the ledger sheet C faces upward, the printed matters on the ledger sheet C can be seem from another person. To such an issue, the platen roller 25 may be provided on the upper side, such that the thermal print head 24 is provided opposite to the platen roller 25 across the second paper transport path 21 and the printing surface A17 of the roll paper 15 faces the thermal print head 24. The heat-sensitive layer on which color appears is provided on the printing surface A17 of the roll paper 15. According to this position of the thermal print head 24, the printed matter on the ledger sheet C may not be viewed by another person.

As described above, when either of the first print unit 13 or the second print unit 26 performs the printing, that is, when the multifunction printer 1 is used exclusively by one print unit, whether each of the first and second printing units is used is determined and, when the other printing unit that is not going to be used is not used, the printing is performed. When the other printing unit is used, data indicating that the other printing unit is used is stored in a print unit exclusive portion and it is not possible to use the print unit that is going to be used to perform the printing as long as information indicating the in-use state of the other printing unit is cancelled. Therefore, even when the transport path is shared, it is possible to prevent the printing media from colliding with each other. In addition, it is possible to perform the exclusive control only by determining whether the other print unit is in use. Thus, even when a version of a component related to one print unit is upgraded, only the version of the print unit may be upgraded and a version of the external device (superior application) does not need to be upgraded.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a discharge unit;

a first printing unit disposed along a sheet conveying path extending from the discharge unit and configured to print an image on a first sheet while the first sheet is conveyed from the discharge unit to the first printing unit and then to the discharge unit;

a second printing unit disposed farther from the discharge unit than the first printing unit along the sheet conveyance path and configured to print an image on a second sheet while the second sheet is conveyed towards the discharge unit therethrough, using a printing method that is different from a printing method of the first printing unit;

a data storage that stores data including one-bit data indicating whether or not the first printing unit is in use and one-bit data indicating whether or not the second printing unit is in use; and a controller configured to determine whether or not each of the first and second printing unit is in use by referring to the data, and control only one of the first and second printing units to print, based on the determination.

2. The printer according to claim 1, wherein when the controller determines that the second printing unit is not in use, the controller updates the data so as to indicate that the first printing unit is in use, and then control the first printing unit to print.

3. The printer according to claim 2, wherein the controller is further configured to disable the first printing unit from printing, when the controller determines that the second printing unit is in use.

4. The printer according to claim 2, wherein the controller is further configured to update the data so as to indicate that the first printing unit is not in use after the image is printed on the first sheet by the first printing unit.

5. The printer according to claim 1, wherein when the controller determines that the first printing unit is not in use, the controller updates the data so as to indicate that the second printing unit is in use, and then controls the second printing unit to print.

6. The printer according to claim 5, wherein the controller is further configured to disable the second printing unit from printing, when the controller determines that the first printing unit is in use.

7. The printer according to claim 5, wherein the controller is further configured to update the data so as to indicate that the second printing unit is not in use after the image is printed on the second sheet by the second printing unit.

8. The printer according to claim 1, wherein the printing method of the first printing unit is a dot matrix printing method, and the printing method of the second printing unit is a thermal printing method.

* * * * *